United States Patent [19]

Mason

[11] Patent Number: 4,887,546

[45] Date of Patent: Dec. 19, 1989

[54] LINING OF BORE HOLES

[75] Inventor: Benjamin Mason, Newark, Great Britain

[73] Assignee: Caledonian Mining Co. Ltd., Great Britain

[21] Appl. No.: 125,125

[22] Filed: Nov. 25, 1987

[30] Foreign Application Priority Data

Dec. 3, 1986 [GB] United Kingdom ..... 8628883

[51] Int. Cl.[4] ..... B05B 3/10

[52] U.S. Cl. ..... 118/306; 118/317; 222/635; 239/224

[58] Field of Search ..... 118/306, 317, 323, 301; 222/635; 239/140, 288.4, 274, 223, 224

[56] References Cited

U.S. PATENT DOCUMENTS

| | | | |
|---|---|---|---|
| 2,461,517 | 2/1949 | Carnevale | 118/306 |
| 2,839,026 | 6/1958 | Matheny | 118/306 |
| 2,922,583 | 1/1960 | Perkins | 118/306 X |
| 3,159,895 | 12/1964 | Perovich | 118/306 X |
| 3,401,988 | 9/1968 | Pingree | 118/306 X |
| 3,810,441 | 5/1974 | Padgett et al. | 118/306 X |
| 4,108,384 | 8/1978 | Egli | 118/317 X |
| 4,178,875 | 12/1979 | Moschetti | 118/306 X |
| 4,199,108 | 4/1980 | Baumgartner et al. | 239/662 |
| 4,414,918 | 11/1983 | Holland et al. | 118/306 |

FOREIGN PATENT DOCUMENTS

| | | | |
|---|---|---|---|
| 2150050 | 6/1985 | United Kingdom | 118/306 |

*Primary Examiner*—Shrive Beck

*Attorney, Agent, or Firm*—Wood, Herron & Evans

[57] ABSTRACT

The invention relates to the lining of bore holes with cement or the like by apparatus designed to spray cement directly on to the raw face of the hole. Such apparatus in accordance with the invention comprises a spray head, means to drive the head through the hole and means for delivering cement to the head characterized in that the head has an annular chamber into which cement is fed and from which colloidal cement is fed in an annular ring to a rotatable spray disc or arm which is arranged to distribute the cement substantially evenly over the internal surface of the hole.

The annular feed enables even spray to take place while avoiding problems associated with axle feeding.

5 Claims, 5 Drawing Sheets

80
78
82
78
80
78
80
60
84
84
74
74
62(b)
86
86
62(a)
76
64(a)
72
72
82
78
80
80
80
78
78
70
84
60
84
74
74
66(b)
86
86
66(a)
76
68(a)
72
72
18
2

LINING OF BORE HOLES

This invention relates to the lining of bore holes. It is desirable to line bore holes or the like with for example cement by a process or device which is under remote control thus avoiding the necessity of an operator actually being present in the hole. One example of this is the lining of bore holes connecting underground roadways in a mine. Such holes are conveniently about 1.5 meters in diameter and 200 meters deep and it would be dangerous for anyone to move down such holes manually to apply a cement or concrete lining.

There have been several attempts to solve this problem. Firstly it has been proposed to use pre-formed liner sleeves which are grouted together in situ. This however has led to very difficult problems in alignment and securement.

Secondly it has been proposed to provide shuttering and to cast concrete between the shutter and the raw face of the hole. This has lead to problems of pressure build-up at the bottom of the hole and of proper alignment and positioning of the shuttering members and as well as the undesirably long time taken by the concrete to set.

The third approach has been to try to spray concrete directly on to the raw face of the hole. This has led to difficulties in providing an effective remote controlled concrete spray apparatus which can deliver concrete substantially evenly over the wall of the hole at an acceptable feed rate using 'colloidal cement' i.e. cement into which water is mixed under high shear conditions giving good hydration of cement particles.

The present invention is concerned with the third approach namely the use of remote controlled cement spraying apparatus.

Such cement spraying apparaus has to have means for spraying the cement equally around its circumference so that the hole is evenly coated as the apparatus moves through the hole.

The normal way of achieving even spraying would be to supply the cement through an axially arranged rotatable tube, the lower end of which carries the nozzle head. Problems, however, have been found to arise with such an arrangement, firstly because the axial tube which is rotated at high speed tends to heat up causing the cement to cure in the pipe during spraying constricting the flow of grout. Secondly it has been found that the delivery tubes for the colloidal cement and the air pipe for an air motor to rotate the tube, tend to get tangled up with the haulage ropes for the apparatus if, for example, the apparatus moves around the circumference of the hole during passage therethrough.

Apparatus for spraying cement over the walls of bore holes and the like which solves these problems and which is in accordance with the invention comprises a spray head, means to drive the head through the hole and means for delivering cement to the head wherein the head has an annular chamber into which cement is fed and from which colloidal cement is fed in an annular ring to a rotating spray disc or arm to distribute the cement substantially evenly over the surface of the hole.

The annular feed which enables even spraying to take place, avoids the problems associated with axial feeding whilst at the same time enabling a pump or mixer to be provided in the annular chamber which is a highly desirable (although not essential) feature of a spray apparatus in accordance with the invention. The mixer acts to remix the colloidal cement mix just before spraying to produce well hydrated and plasticised cement for spraying.

According to a second feature of the invention the rotatable part of the spray head, which is preferably driven by an air motor mounted on the top of the apparatus, comprises a number of equally spaced, radially extending spray bars, each bar being mounted on a support plate with a second wider bar being mounted on top of at least the outer end portion of each spray bar.

Channels are thus formed on each side of each spray bar between the top bar and the plate and in use, a thin film of cement is fed into these channels at the inner end of the spray bars from the annular chamber, the cement flowing continuously out along the channels to be discharged from the ends thereof against the wall of the bore hole.

It has been found that if a pin is inserted traversely across the channels this acts to cause the cement to be discharged in a desirable spray pattern e.g. conical.

The support for the spray head unit is preferably provided with eight wheels arranged in four pairs, two at one end and two at the other, the wheels of each pair being positioned on opposite sides of the apparatus, and the wheels of one pair of each end being supported on axes at right angles to those of the wheels of the other pair at that end so that if one wheel enters a pot hole or the like in the wall of the hole the other wheels will act to continue to hold the head centrally in the hole. It is desirable that the radius of the wheels be greater than or equal to the depth of the usual pot holes or irregularities in the bore hole wall.

The invention will now be further described by way of example with reference to the accompanying drawings in which.

Figure 1:
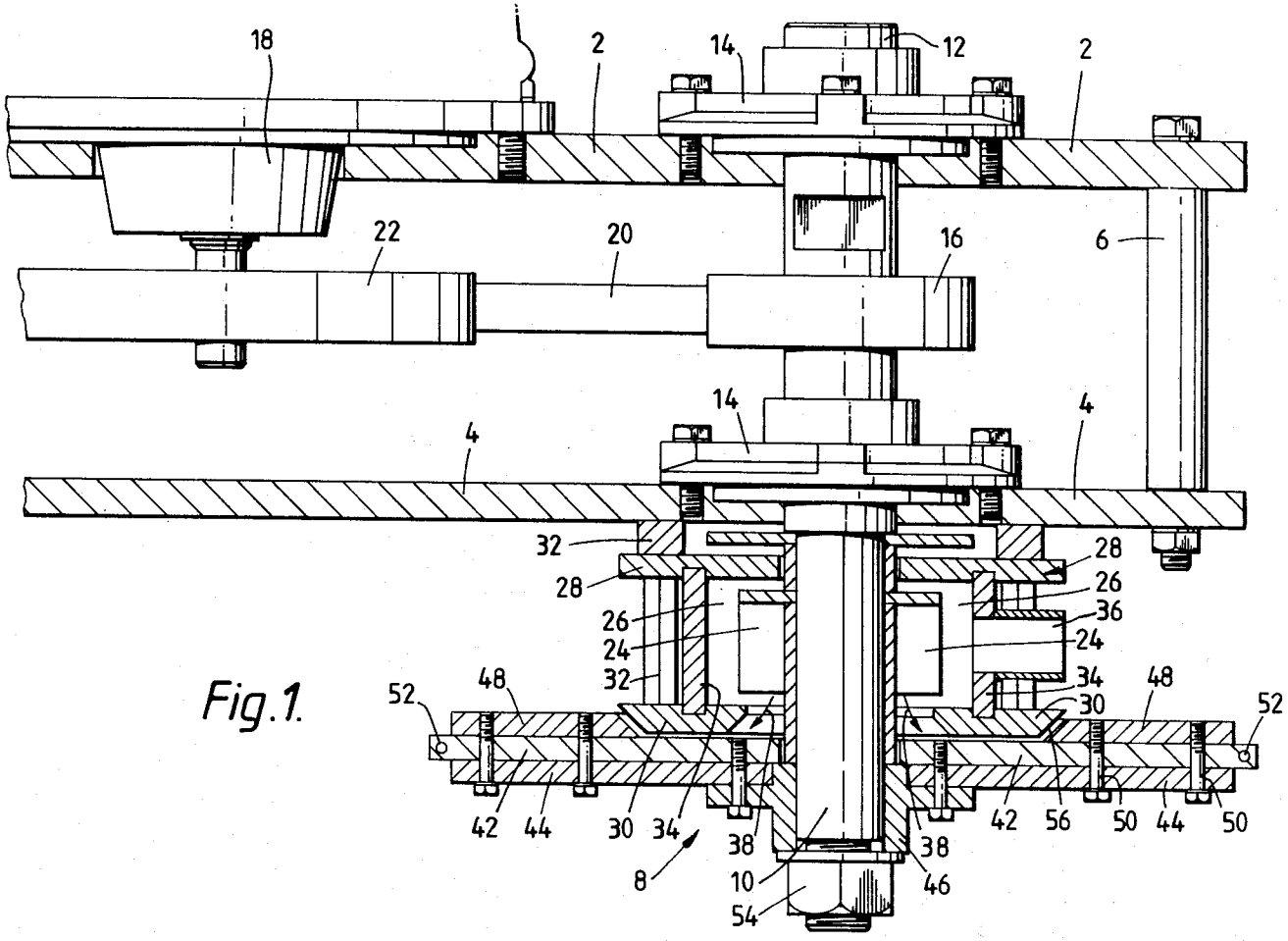
FIG. 1 is a section on the centre line of a preferred embodiment of spray apparatus in accordance with the invention.
Figure 2:
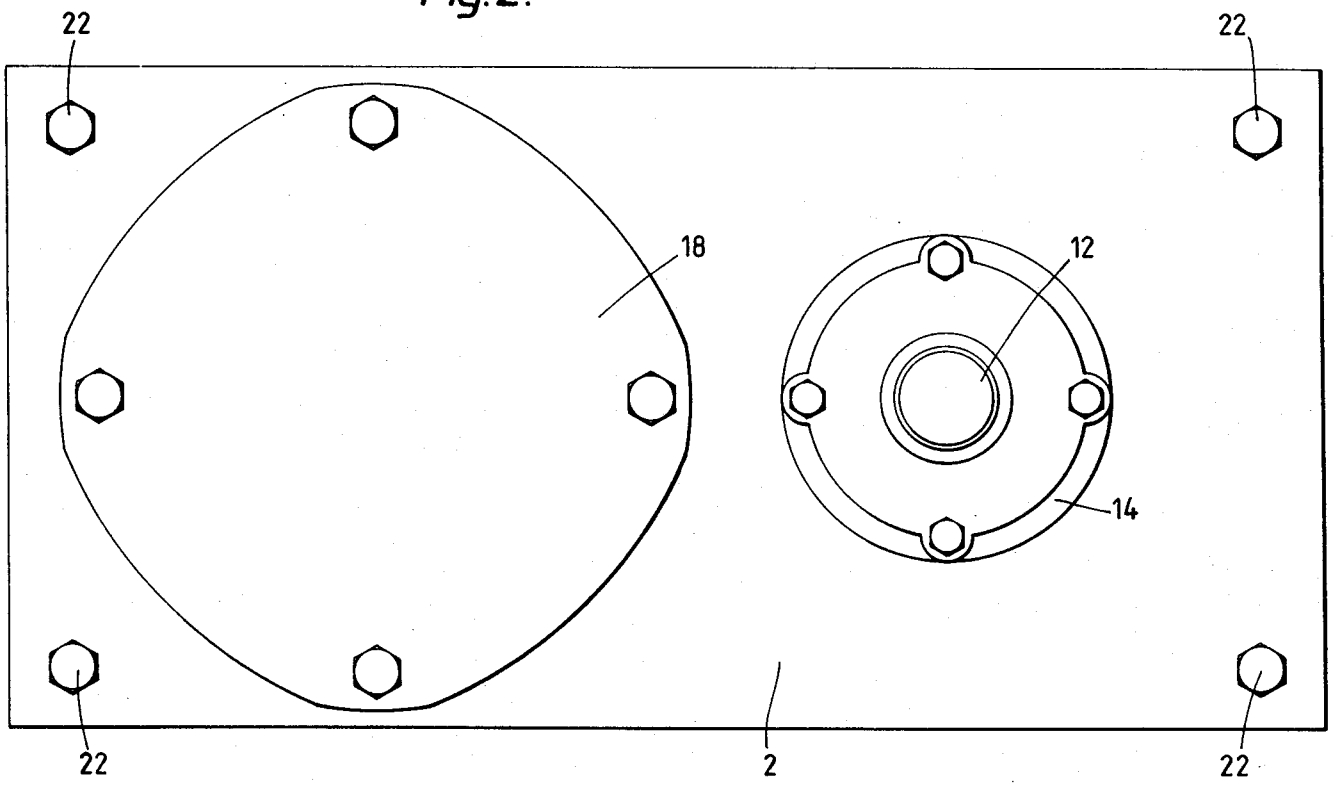
FIG. 2 is an plan view to half scale, of the apparatus illustrated in FIG. 1.

Referring to FIG. 1 the spray head unit comprises a framework comprising upper and lower support plates 2, 4 connected by bolts 6.

A spray head unit generally indicated at 8, is connected to a drive shaft 10, the shaft being rotatably mounted in bearings 14, on the two support plates with its lower end being positioned beneath the bottom plate 4.

The upper end 12 of the drive shaft carries a toothed wheel 16 driven by an air motor 18 through a toothed belt 20 and wheel 22 carried by the drive shaft of the air motor. The drive arrangement is such that the drive shaft and spray head may be rotated at around 3000 r.p.m. depending on the application.

The portion of the drive shaft 10 extending below the bottom support plate 4 carries pump blades 24 which rotate within a chamber 26 formed between upper and lower plates 28, 30, the plates being carried by bolts 32, from the support plate 4.

The outer wall 34 of the chamber is supported between the plates 28, 30.

Figure 3:
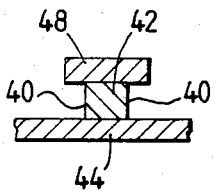
FIG. 3 is a detailed sketch view of the spray bar unit.

A colloidal mixture of cement and water is fed into the chamber 26 through an inlet 36 at a rate of about 1 to 2 cubic meters per hour. The colloidal cement within the chamber is remoxed by the blades 24 and a balanced pressure is maintained within the chamber. The inlet pressure at the inlet 36 is higher than the pressure generated by the pump blades 24 in chamber 26, so that the cement mixture is able to enter the chamber and it then tends to escape above and below the blades. Above the blade there is a labyrinth seal which effectively prevents cement from escaping but below the blades there is a passage indicated at 38 through which well mixed colloidal cement may flow evenly all around the inside of lower plate 30 into a passage 47 alongside a spray bar 42. A number of equally spaced spray bars 42 are attached at intervals around a support plate 64 to extend radially outwardly above the plate. The plate 44 is connected to a boss 46 driven by the main shaft 10. The outer end portion of each spray bar 42 has a top bar 48 secured by bolts 50 so as to overlie the spray bars 42 as illustrated in FIG. 3 leaving channels of about 10 millimeters in height and above five milimeters deep on each side to receive the colloidal cement mixture being fed out from the annular chamber 26.

When the spray bars 42 hit the colloidal cement which is delivering under pressure from impeller 24 rotating in the mixing chamber 26 through passage 38, the bars, which are being rotated at high speed, in effect slice off some of the cement grout which is then caused by centrifugal force to flow over the vertical faces of the bar 42 between the plate 44 and top bar 48 out towards the periphery of the plate.

At the outer end of each bar a traverse pin 52 is secured, against which the outwardly flowing cement egages and which acts to cause the cement to be sprayed out from the end of the bars in a conical pattern around the perimeter of the head and against the wall of the hole. As an example a 6 millimeter pin will give an 80 milimeter spread in a 1.5 meter diameter bore hole. The pin is preferably of a type such as a Roll pin or "Seloc Dowel" which may be readily replaced when worn.

It will be appreciated that the apparatus can be very readily cleaned merely by undoing the main nut 54 from the bottom of the main shaft 10 allowing the boss 46, plate 44 to be removed and cleaned. Also releasing bolt 32 allows removal of bottom plate 30, chamber 34, impeller 24 and top plate 28 for easy cleaning.

It will be seen that the outer end of the plate 30 and the corresponding inner end of the bars 48 are shamfered at 56.

In use the apparatus is designed to be hauled through a bore at a rate of about 1 meter per minute which is intended to produce a sprayed layer of cement on the wall of the hole of about 5 milimeters in thickness.

Figure 5:
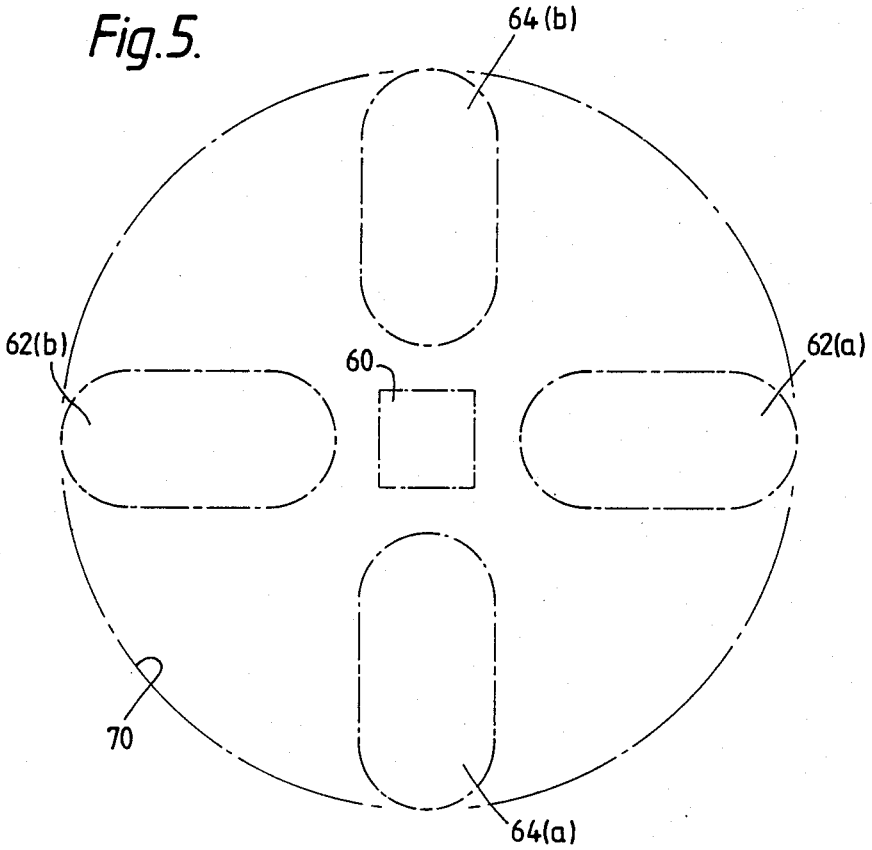
FIG. 5 is a plan view of FIG. 4.
Figure 4:
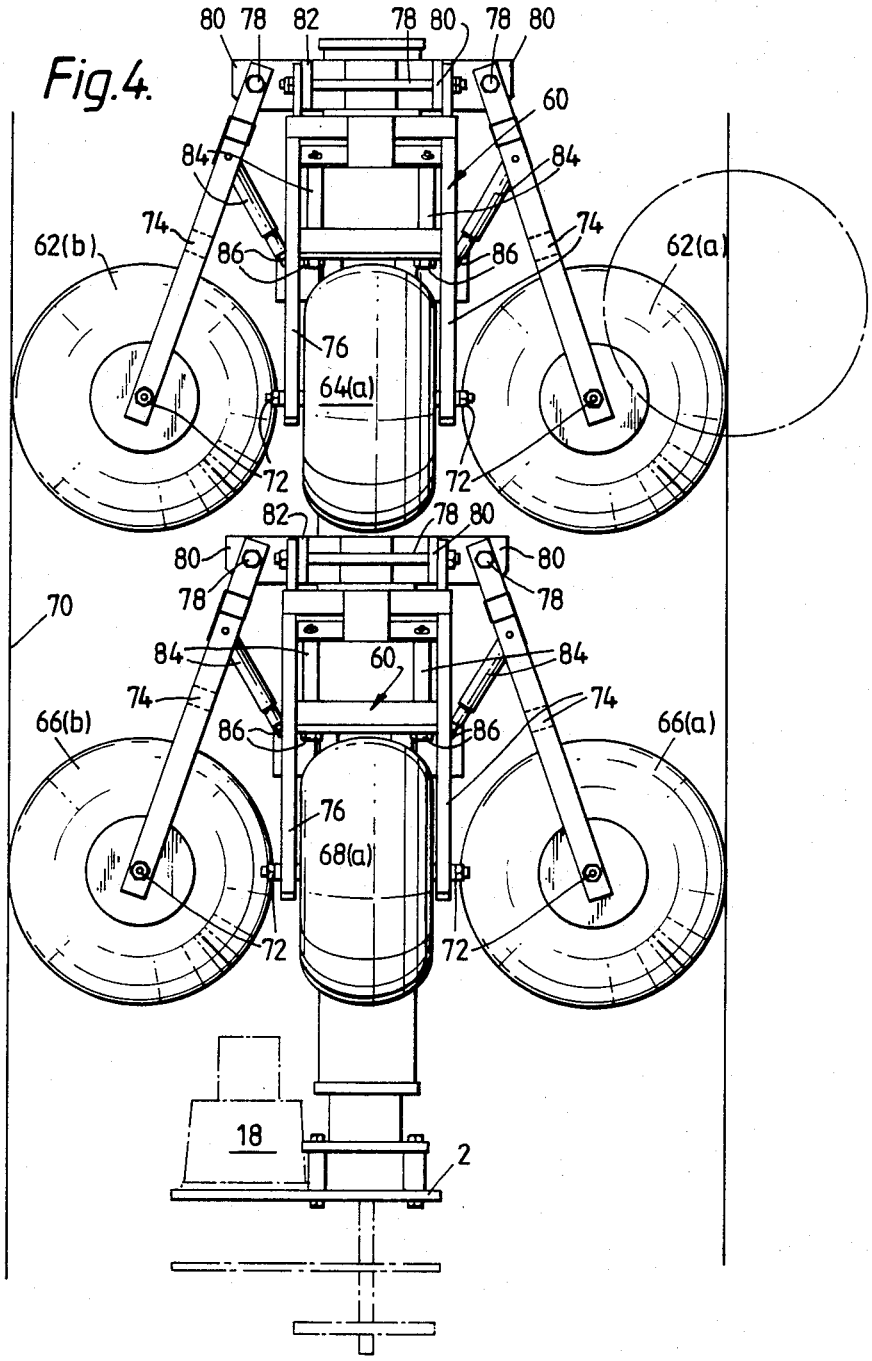
FIG. 4 is a view of the support frame illustrating the drive wheel system.
Figure 6:
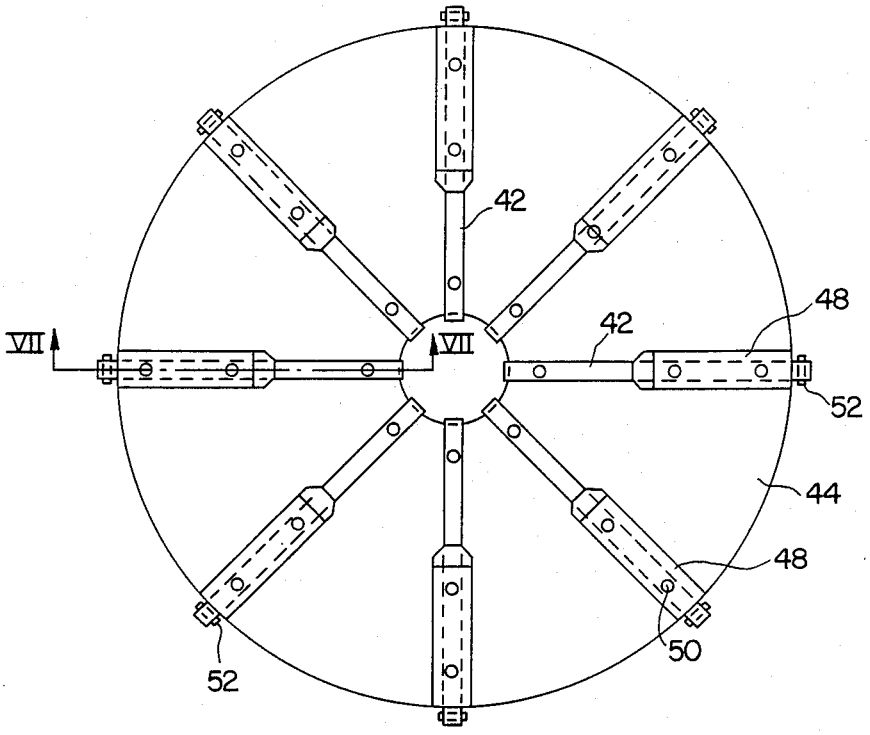
FIG. 6 is a plan view of a spray disc for the apparatus.
Figure 7:
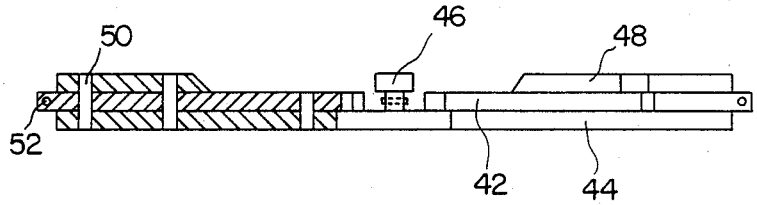
FIG. 7 is a sectional view taken along line VII—VII of FIG. 6.

Referring to FIG. 4 the spray head unit is supported from a support framework generally indicated at 60 carrying four pairs of wheels 62(*a*) and (*b*), 64(*a*) and (*b*), 66(*a*) and (*b*) and 68(*a*) and (*b*) respectively. As can be seen with reference to FIGS. 4 and 5 the wheels (a) and (b) of each pair are positioned on opposite sides of the framework 60 to engage opposite sides of the bore hole generally indicated at 70.

The pairs of wheels 62 and 64 are situated at the upper end of the support framework as seen in FIG. 4 and the pairs of wheels 66, 68 are located at the bottom end of the framework. The planes of the wheels in the pair 62 at the top of the framework and hence their axes are located at right angles to those of the pairs of wheels 64 and the same arrangement is present with the pairs of wheels 66, 68 at the bottom of the frame 60.

The axes 72 of the wheels are carried at the end of support legs 74. The legs are pivotally mounted about pivots 78 carried by brackets 80, 82 extending out from the framework 60. The wheels are urged outwardly away from the framework by means of pneumatic pistons/cylinders 84 connected both to the brackets 74 and pivotally connected at 86 to the framework. The cylinders 84 of the wheel supports for the two wheels for each pair are connected pneumatically so that the pressure urging each wheel of a pair, outwardly is equal. This has the advantage that if for example one wheel, say wheel 62(*a*) as shown in FIG. 4, falls into a pot hole or "breakout" in the side of the hole the pressure within the strut 84 providing the outward urge for the wheel 62(*a*) reduces causing a corresponding reduction in the force urging the wheel 62(*b*) outwardly. Thus the wheel 62(*b*) does not have any significant unbalanced force tending to move the frame off the centre line of the bore hole. Indeed the arrangement of the four pairs of wheels is such that the framework and hence the spray head can move smoothly up the bore hole whilst at the same time retaining the axis of the spray head unit substantially aligned with the axis of the bore hole.

The wheels preferably have a radius which is equal to or larger than the depth of any pot hole or depression which is likely to be found in the wall of the hole. In this way even if one wheel enters a depression the other wheels will act to hold the unit central until the wheel within the depression in effect rides out therefrom. The engagement of the wheels on the wall prevent turning of the unit.

It is found that this is preferable to an arrangement in which the spray unit is mounted on sledge members biased outwardly to engage the walls of the hole.

In this case one has to exercise considerable outward pressure on the sledge members to stop the unit turning, and this pressure against the surface of the wall tends to cause the upward movement of the unit to be erratic.

What I claim is:

1. Apparatus for spraying cement on the walls of a bore hole, said apparatus comprising a spray head comprising an annular chamber into which cement is fed from a supply source elevated above said spray head, plural blades positioned within said chamber, said blades being rotatable to re-mix said cement within said chamber, means connected with said blades to rotate said blades at a relatively high speed, that rotation speed being sufficient to limit the outlet pressure of said cement from said chamber to a desired substantially constant value relative to the changing head pressure of said cement as delivered to said chamber when said supply source is located substantially above said spray head and as the distance between said apparatus and said supply source increases, an annular outlet for exhausting cement from said chamber, and a rotatable spray disc arranged to receive cement from said annular outlet, said spray disc being adapted to distribute said cement substantially evenly over the internal surface of said hole because the outlet pressure of said cement from said chamber remains substantially constant regardless of the vertical location of said spray head beneath said supply source, said rotatable spray disc comprising a support plate, plural radially extending spray bars mounted on said plate, and a second wider bar mounted on top at least the outer end portion of each spray bar, thereby forming a channel on each side of each spray bar, means to move said head through said bore hole, said head being connected to said move means, and means for delivering cement to said head, said delivery means being connected to said head and to said supply source.

2. Apparatus as claimed in claim 1, said apparatus comprising an air motor connected to said head, said air motor being adapted to rotate said spray disc.

3. Apparatus as claimed in claim 1, said rotatable spray disc comprising a pin mounted adjacent the outer end of each spray bar, said pin being positioned traversely across the channel formed on each side of each spray bar.

4. Apparatus as claimed in claim 1, said move means comprising a framework connected to said spray head for supporting said spray head in said hole, and four pairs of wheels attached to said framework for guiding said framework through said hole, two wheel pairs being at one end and two wheel pairs being at the other end of said framework, the wheels of each pair being positioned on opposite sides of said framework, and the wheels of one pair at each end being supported on axes at right angles of those of the wheels of the other pair at that end.

5. Apparatus as claimed in claim 4, the radius of said wheels being not less than the depth of normal pot holes or irregularities to be found in the wall of said bore hole.

* * * * *

UNITED STATES PATENT AND TRADEMARK OFFICE

CERTIFICATE OF CORRECTION

PATENT NO. : 4,887,546

DATED : December 19, 1989

INVENTOR(S) : Benjamin Mason

It is certified that error appears in the above-identified patent and that said Letters Patent is hereby corrected as shown below:

In the Abstract - second to last line delete "while" and insert --whilst--

Column 1, line 37 delete "apparaus" and insert --apparatus--

Column 2, line 26 delete "of" and insert --at-- (2nd occurrence)

Column 2, line 40 delete "an" and insert --a--

Column 3, line 6 delete "remoxed" and insert --remixed--

Column 3, line 16 delete "47" and insert --48--

Column 3, line 18 delete "64" and insert --44--

Column 3, line 49 delete "plate" and insert --plates--

Column 6, line 17 delete "of" and insert --to-- (1st occurrence)

Signed and Sealed this

Twenty-fifth Day of June, 1991

*Attest:*

*Attesting Officer*

HARRY F. MANBECK, JR.

*Commissioner of Patents and Trademarks*